US011053456B2

(12) United States Patent
Ozaki et al.

(10) Patent No.: US 11,053,456 B2
(45) **Date of Patent: *Jul. 6, 2021**

(54) DETERGENT COMPOSITION FOR TEXTILE PRODUCTS

(71) Applicant: Kao Corporation, Tokyo (JP)

(72) Inventors: Takanori Ozaki, Tokyo (JP); Kosuke Tawa, Wakayama (JP); Yuichiro Tase, Wakayama (JP)

(73) Assignee: KAO CORPORATION, Tokyo (JP)

( * ) Notice: Subject to any disclaimer, the term of this patent is extended or adjusted under 35 U.S.C. 154(b) by 178 days.

This patent is subject to a terminal disclaimer.

(21) Appl. No.: 16/303,478

(22) PCT Filed: May 30, 2017

(86) PCT No.: PCT/JP2017/020059

§ 371 (c)(1),
(2) Date: Nov. 20, 2018

(87) PCT Pub. No.: WO2017/209116

PCT Pub. Date: Dec. 7, 2017

(65) Prior Publication Data

US 2020/0318034 A1 Oct. 8, 2020

(30) Foreign Application Priority Data

May 31, 2016 (JP) ..... JP2016-108441

(51) Int. Cl.

| | |
|---|---|
| ***C11D 1/831*** | (2006.01) |
| ***C11D 1/14*** | (2006.01) |
| ***C11D 1/72*** | (2006.01) |
| ***C11D 11/00*** | (2006.01) |
| ***C11D 17/00*** | (2006.01) |

(52) U.S. Cl.
CPC ..... *C11D 1/831* (2013.01); *C11D 1/143* (2013.01); *C11D 1/72* (2013.01); *C11D 11/0017* (2013.01); *C11D 17/0008* (2013.01)

(58) Field of Classification Search
CPC ..... C11D 1/831; C11D 1/12
See application file for complete search history.

(56) References Cited

U.S. PATENT DOCUMENTS

| | | | | |
|---|---|---|---|---|
| 4,029,608 | A | 6/1977 | Murata et al. | |
| 4,107,095 | A * | 8/1978 | Klisch | C11D 1/29 510/237 |
| 4,507,223 | A | 3/1985 | Tano et al. | |
| 4,549,607 | A | 10/1985 | Morita et al. | |
| 5,078,916 | A * | 1/1992 | Kok | C11D 1/143 510/488 |
| 2006/0277688 | A1 | 12/2006 | Ishikawa et al. | |
| 2007/0203053 | A1 | 8/2007 | Torres et al. | |
| 2009/0022812 | A1 | 1/2009 | Maki et al. | |
| 2014/0076345 | A1 | 3/2014 | Fujii et al. | |
| 2014/0079658 | A1 | 3/2014 | Terazaki et al. | |
| 2014/0079660 | A1 | 3/2014 | Doi | |
| 2014/0080746 | A1 | 3/2014 | Doi et al. | |
| 2014/0336409 | A1 | 11/2014 | Barnes et al. | |
| 2015/0202134 | A1* | 7/2015 | Yoshikawa | A61Q 19/10 510/127 |
| 2015/0275133 | A1 | 10/2015 | Doi | |
| 2015/0366774 | A1 | 12/2015 | Yoshikawa et al. | |
| 2015/0366775 | A1 | 12/2015 | Yoshikawa et al. | |
| 2016/0332961 | A1 | 11/2016 | Hori et al. | |
| 2017/0079899 | A1 | 3/2017 | Li et al. | |
| 2017/0114270 | A1 | 4/2017 | Ravikiran et al. | |

FOREIGN PATENT DOCUMENTS

| | | | |
|---|---|---|---|
| CA | 2026746 | A1 | 4/1991 |
| CN | 104560283 | A | 4/2015 |
| CN | 104603251 | A | 5/2015 |
| CN | 105238573 | A | 1/2016 |
| CN | 105255602 | A | 1/2016 |
| CN | 105849085 | A | 8/2016 |
| EP | 0377261 | A2 | 7/1990 |
| EP | 0482687 | A1 | 4/1992 |
| EP | 2 899 257 | A1 | 7/2015 |
| EP | 2 899 258 | A1 | 7/2015 |
| EP | 3088386 | A1 | 11/2016 |
| JP | 59-27995 | A | 2/1984 |
| JP | 60-096693 | A | 5/1985 |
| JP | 62-297400 | A | 12/1987 |
| JP | 3-126793 | A | 5/1991 |
| JP | 5-39212 | A | 2/1993 |

(Continued)

OTHER PUBLICATIONS

U.S. Appl. No. 16/303,354, filed Nov. 20, 2018, Not Yet Assigned.
U.S. Appl. No. 16/303,552, filed Nov. 20, 2018, Not Yet Assigned.
International Preliminary Report on Patentability and English translation of the Written Opinion of the International Searching Authority (forms PCT/IB/373 and PCT/ISA/237), dated Dec. 4, 2018, for International Application No. PCT/JP2017/020059.
International Preliminary Report on Patentability and English translation of the Written Opinion of the International Searching Authority (forms PCT/IB/373 and PCT/ISA/237), dated Dec. 4, 2018, for International Application No. PCT/JP2017/020061.
International Preliminary Report on Patentability and English translation of the Written Opinion of the International Searching Authority (forms PCT/IB/373 and PCT/ISA/237), dated Dec. 4, 2018, for International Application No. PCT/JP2017/020063.
JP-2003-81935-A, published Mar. 19, 2003, with machine translation.

(Continued)

*Primary Examiner* — Necholus Ogden, Jr.
(74) *Attorney, Agent, or Firm* — Birch, Stewart, Kolasch & Birch, LLP

(57) ABSTRACT

The present invention relates to a detergent composition for textile products containing the following component (A) and component (B):

component (A): an internal olefin sulfonate having 15 or more and 24 or less carbon atoms and including an internal olefin sulfonate having 15 or more and 24 or less carbon atoms with the sulfonate group at position 5 or higher, and component (B): a nonionic surfactant having an HLB of more than 10.5 and 19 or less.

20 Claims, No Drawings

(56) References Cited

FOREIGN PATENT DOCUMENTS

| | | | |
|---|---|---|---|
| JP | 6-316700 | A | 11/1994 |
| JP | 10-298597 | A | 11/1998 |
| JP | 2001-247534 | A | 9/2001 |
| JP | 2003-081935 | A | 3/2003 |
| JP | 2011-32456 | A | 2/2011 |
| JP | 2014-076988 | A | 5/2014 |
| JP | 2014-077126 | A | 5/2014 |
| JP | 2014-167107 | A | 9/2014 |
| JP | 2014-177620 | A | 9/2014 |
| JP | 2015-27977 | A | 2/2015 |
| JP | 2015-028123 | A | 2/2015 |
| JP | 2015-506340 | A | 3/2015 |
| JP | 2015-143203 | A | 8/2015 |
| JP | 2015-178466 | A | 10/2015 |
| JP | 2015-178548 | A | 10/2015 |
| RU | 2463339 | C2 | 10/2012 |
| TW | 200517556 | A | 6/2005 |
| TW | 200632091 | A | 9/2006 |
| TW | 201414501 | A | 4/2014 |
| WO | WO 2014/046176 | A1 | 3/2014 |
| WO | WO 2015/098415 | A1 | 7/2015 |

OTHER PUBLICATIONS

JP-60-96693-A, published May 30, 1985, with machine translation.
Nagayama et al., "Aspects in Chemistry of Fatty-acid Sulfonic Acid," Journal of Synthetic Organic Chemistry, Japan, vol. 29, No. 7, 1971, pp. 639-653 (18 pages total), with machine translation of pp. 639-640).
International Search Report (PCT/ISA/210) issued in PCT/JP2017/020061, dated Aug. 15, 2017.
International Search Report (PCT/ISA/210) issued in PCT/JP2017/020063, dated Jul. 25, 2017.
Chinese Office Action and Search Report dated Dec. 4, 2019, for Chinese Patent Application No. 201780033632.X, with partial translation.
Extended European Search Report for corresponding European Application No. 17806669.2, dated Nov. 14, 2019.
Extended European Search Report for European Application No. 17806671.8, dated Nov. 19, 2019.
Extended European Search Report for European Application No. 17806673.4, dated Nov. 19, 2019.
International Search Report (PCT/ISA/210) issued in PCT/JP2017/020059, dated Jul. 4, 2017.
Russian Office Action and Search Report for Russian Application No. 2018145760, dated Jun. 22, 2020, with English translation.
Japanese Office Action for Japanese Application No. 2017-106500, dated Mar. 9, 2021.
Japanese Office Action for Japanese Application No. 2017-106503, dated Mar. 16, 2021.
Taiwanese Office Action and Search Report for Taiwanese Application No. 106117935, dated Apr. 7, 2021.
Taiwanese Office Action and Search Report for Taiwanese Application No. 106117976, dated Apr. 7, 2021.

* cited by examiner

DETERGENT COMPOSITION FOR TEXTILE PRODUCTS

FIELD OF THE INVENTION

The present invention relates to a detergent composition for textile products, a method for washing textile products and a method for producing a detergent composition for textile products.

BACKGROUND OF THE INVENTION

Heretofore, an anionic surfactant, particularly an alkylbenzene sulfonate, a nonionic surfactant having an oxyalkylene group having 2 to 3 carbon atoms and an olefin sulfonate, particularly an internal olefin sulfonate obtained by using, as a raw material, an internal olefin having a double bond not at the end of an olefin chain but inside the olefin chain have been widely used as household and industrial detergent components.

JP-A 2011-32456 describes a detergent composition containing a surfactant system, having a low adsorbability to fibers, which consists of a nonionic surfactant such as a particular polyoxyethylene polyoxyalkylene alkyl ether and an anionic surfactant. As an anionic surfactant, an alkylbenzene sulfonate is specifically disclosed.

JP-A 2015-28123 discloses an internal olefin sulfonate composition excellent in foamability and the like which contains an internal olefin sulfonate having 16 carbon atoms and an internal olefin sulfonate having 18 carbon atoms in a particular ratio and having a particular ratio of hydroxy form/olefin form.

EP-A 377261 discloses a detergent composition containing an internal olefin sulfonate, in which its f3-hydroxy form is 250 or more, having an excellent detergent property. Specifically, it describes a laundry detergent composition containing the internal olefin sulfonate and a nonionic surfactant.

JP-A 2003-81935 discloses a detergent composition containing an internal olefin sulfonate characterized in that it is obtained by sulfonating, neutralizing and hydrolyzing an internal olefin having 8 to 30 carbon atoms in which the total percentage of double bonds present at position 2 is 20 to 95% and the cis/trans ratio is 1/9 to 6/4. In Formulation Example 1, a granular detergent composition for clothing containing an internal olefin sulfonate and a nonionic surfactant having a polyoxyethylene group is described.

JP-A 3-126793 discloses a detergent composition containing an internal olefin sulfonate derived from an internal olefin having 12 to 18 carbon atoms and a nonionic surfactant having an HLB value of 10.5 or less in a particular ratio.

SUMMARY OF THE INVENTION

The present invention relates to a detergent composition for textile products in which a surfactant is less likely to adsorb to fibers after washing, a method for washing textile products, and a method for producing the detergent composition for textile products.

The present invention also relates to a detergent composition for textile products which exhibits a constant detergency to textile products when an internal olefin sulfonate obtained by using an internal olefin as a raw material is used, a method for washing textile products, and a method for producing the detergent composition for textile products.

Accordingly, the present invention relates to a detergent composition for textile products containing the following component (A) and component (B):

component (A): an internal olefin sulfonate having 15 or more and 24 or less carbon atoms and including an internal olefin sulfonate having 15 or more and 24 or less carbon atoms with the sulfonate group at position 5 or higher, and component (B): a nonionic surfactant having an HLB of more than 10.5 and 19 or less.

In one aspect, the present invention relates to a detergent composition for textile products containing the following component (A1) and component (B):

component (A1): an internal olefin sulfonate obtained by using as a raw material an internal olefin including an internal olefin having 15 or more and 24 or less carbon atoms with a double bond at position 5 or higher, and component (B): a nonionic surfactant having an HLB of more than 10.5 and 19 or less.

In another aspect, the present invention relates to a detergent composition for textile products containing the following component (A) and component (B):

component (A): an internal olefin sulfonate having 15 or more and 24 or less carbon atoms and including an internal olefin sulfonate having 15 or more and 24 or less carbon atoms with the sulfonate group at position 5 or higher, obtained by using as a raw material an internal olefin including an internal olefin having 15 or more and 24 or less carbon atoms with a double bond at position 5 or higher, and component (B): a nonionic surfactant having an HLB of more than 10.5 and 19 or less.

The present invention also relates to a method for washing textile products with a detergent liquid containing the following component (A) and component (B), and water, wherein the hardness of the detergent liquid is more than 0° dH:

component (A): an internal olefin sulfonate having 15 or more and 24 or less carbon atoms and including an internal olefin sulfonate having 15 or more and 24 or less carbon atoms with the sulfonate group at position 5 or higher, and component (B): a nonionic surfactant having an HLB of more than 10.5 and 19 or less.

In another aspect, the present invention also relates to a method for washing textile products with a detergent liquid containing the following component (A1) and component (B), and water, wherein the hardness of the water in the detergent liquid is more than 0° dH:

component (A1): an internal olefin sulfonate obtained by using as a raw material an internal olefin including an internal olefin having 15 or more and 24 or less carbon atoms with a double bond at position 5 or higher, component (B): a nonionic surfactant having an HLB of more than 10.5 and 19 or less.

In another aspect, the present invention relates to a method for washing textile products with a detergent liquid containing the following component (A) and component (B), and water, wherein the hardness of the detergent liquid is more than 0° dH:

component (A): an internal olefin sulfonate having 15 or more and 24 or less carbon atoms and including an internal olefin sulfonate having 15 or more and 24 or less carbon atoms with the sulfonate group at position 5 or higher, obtained by using as a raw material an internal olefin including an internal olefin having 15 or more and 24 or less carbon atoms with a double bond at position 5 or higher, component (B): a nonionic surfactant having an HLB of more than 10.5 and 19 or less.

The present invention also relates to a method for producing a detergent composition for textile products, including mixing the following component (A) and component (B):

component (A): an internal olefin sulfonate having 15 or more and 24 or less carbon atoms and including an internal olefin sulfonate having 15 or more and 24 or less carbon atoms with the sulfonate group at position 5 or higher, and component (B): a nonionic surfactant having an HLB of more than 10.5 and 19 or less.

In another aspect, the present invention also relates to a method for producing a detergent composition for textile products, including mixing the following component (A1) and component (B):

component (A1): an internal olefin sulfonate obtained by using as a raw material an internal olefin including an internal olefin having 15 or more and 24 or less carbon atoms with a double bond at position 5 or higher, and component (B): a nonionic surfactant having an HLB of more than 10.5 and 19 or less.

In another aspect, the present invention relates to a method for producing a detergent composition for textile products, including mixing the following component (A) and component (B):

component (A): an internal olefin sulfonate having 15 or more and 24 or less carbon atoms and including an internal olefin sulfonate having 15 or more and 24 or less carbon atoms with the sulfonate group at position 5 or higher, obtained by using as a raw material an internal olefin including an internal olefin having 15 or more and 24 or less carbon atoms with a double bond at position 5 or higher, and component (B): a nonionic surfactant having an HLB of more than 10.5 and 19 or less.

According to the present invention, it is possible to provide a detergent composition for textile products in which a surfactant is less likely to adsorb to fibers after washing, a method for washing textile products, and a method for producing the detergent composition for textile products.

According to the present invention, it is also possible to provide a detergent composition for textile products which can provide a constant detergency to textile products when an internal olefin sulfonate obtained by using an internal olefin as a raw material is used, a method for washing textile products, and a method for producing the detergent composition for textile products.

Embodiments of the Invention

<Detergent Composition for Textile Products>

The present inventors have found that among many anionic surfactants, an internal olefin sulfonate having 15 or more and 24 or less carbon atoms and including an internal olefin sulfonate having 15 or more and 24 or less carbon atoms with the sulfonate group at position 5 or higher is less likely to adsorb to fibers after washing. They have also found that adsorbability of surfactant to fibers is further decreased by using a nonionic surfactant having a particular HLB in combination with the above-mentioned internal olefin sulfonate. It is assumed that rinsing after washing the textile product becomes easier due to a further decrease in the adsorbability of surfactant to the fibers.

<Component (A)>

Component (A) of the present invention is an internal olefin sulfonate having 15 or more and 24 or less carbon atoms and including an internal olefin sulfonate having 15 or more and 24 or less carbon atoms with the sulfonate group at position 5 or higher, which has the effect of washing off stains attached to fibers. It is also a compound which has a lower adsorbability to fibers at washing.

The number of carbon atoms of the internal olefin sulfonate in component (A) refers to the number of carbon atoms of the internal olefin to which the sulfonate is covalently bonded. The number of carbon atoms of the internal olefin sulfonate in component (A) is, from the viewpoint of further improving the detergent property against stains attached to textile products, 15 or more and preferably 16 or more, and from the viewpoint of further reducing the adsorption amount of the surfactant to textile products, 24 or less, preferably 22 or less, more preferably 20 or less and further preferably 18 or less. Component (A) of the present invention is an internal olefin sulfonate having 15 or more and 24 or less carbon atoms, and including an internal olefin sulfonate having 15 or more and 24 or less carbon atoms with the sulfonate group at position 5 or higher.

From the viewpoint of further reducing the adsorption amount of the surfactant to textile products, component (A) is preferably one or more selected from the following component (a1) and component (a2), wherein the mass ratio (a2)/(a1) of component (a2) to component (a1) is 0 or more and 1 or less:

component (a1): an internal olefin sulfonate having 15 or more and 16 or less carbon atoms and including an internal olefin sulfonate having 15 or more and 16 or less carbon atoms with the sulfonate group at position 5 or higher, and component (a2): an internal olefin sulfonate having 17 or more and 24 or less carbon atoms and including an internal olefin sulfonate having 17 or more and 24 or less carbon atoms with the sulfonate group at position 5 or higher.

From the viewpoint of further reducing the amount of the surfactant adsorbed to fibers at washing, the mass ratio (a2)/(a1) of component (a2) to component (a1) is 0 or more, and 1 or less, preferably 0.95 or less, more preferably 0.9 or less, further preferably 0.8 or less, furthermore preferably 0.7 or less, furthermore preferably 0.6 or less, furthermore preferably 0.5 or less, furthermore preferably 0.4 or less, furthermore preferably 0.3 or less, furthermore preferably 0.2 or less, furthermore preferably 0.1 or less, furthermore preferably 0.05 or less and furthermore preferably 0.

In addition, from the viewpoint of further improving the detergent property against stains attached to fibers, the mass ratio (a2)/(a1) of component (a2) to component (a1) is 1 or less, and 0 or more, preferably 0.05 or more, more preferably 0.1 or more, further preferably 0.2 or more, furthermore preferably 0.3 or more, furthermore preferably 0.4 or more, furthermore preferably 0.5 or more, furthermore preferably 0.6 or more, furthermore preferably 0.7 or more, furthermore preferably 0.8 or more, furthermore preferably 0.9 or more and furthermore preferably 1.

Further, from the viewpoint of further reducing the amount of the surfactant adsorbed to fibers at washing and further improving the detergent property against stains attached to fibers, the mass ratio (a2)/(a1) of component (a2) to component (a1) is 0 or more, preferably 0.05 or more and more preferably 0.1 or more, and 1 or less, preferably 0.95 or less, more preferably 0.9 or less, further preferably 0.8 or less, furthermore preferably 0.7 or less, furthermore preferably 0.6 or less and furthermore preferably 0.5 or less.

Furthermore, from the viewpoint of further reducing the adsorption amount of the surfactant to textile products, component (A) is preferably one or more selected from the following components (a11) and component (a21), wherein the mass ratio (a21)/(a11) of component (a21) to component (a11) is 0 or more and 1 or less:

component (a11): an internal olefin sulfonate with the sulfonate group at position 5 or higher, obtained from an internal olefin including an internal olefin having 15 or more and 16 or less carbon atoms with a double bond at position 5 or higher, and component (a21): an internal olefin sulfonate with the sulfonate group at position 5 or higher, obtained from an internal olefin including an internal olefin having 17 or more and 24 or less carbon atoms with a double bond at position 5 or higher, wherein the mass ratio (a21)/(a11) of component (a21) to component (a11) is 0 or more and 1 or less.

In this case, it is also possible that component (a11) is replaced with component (a1) and component (a21) is replaced with component (a2), and the above-mentioned preferred range is applied to them.

The internal olefin sulfonate of the present invention is preferably a sulfonate obtained by sulfonating, neutralizing and hydrolyzing an internal olefin (an olefin having a double bond inside an olefin chain) including an internal olefin having 15 or more and 24 or less carbon atoms and having a double bond at position 5 or higher as a raw material.

Such an internal olefin also includes those containing a trace amount of so-called alpha-olefin (hereinafter also referred to as α-olefin) in which the double bond is present at position 1 of the carbon chain.

When an internal olefin is sulfonated, β-sultone is produced quantitatively, and a part of β-sultone is changed to γ-sultone and an olefin sulfonate, and further converted to a hydroxyalkane sulfonate and an olefin sulfonate in the process of neutralization and hydrolysis (e.g., J. Am. Oil Chem. Soc. 69, 39 (1992)). The hydroxy group of the resulting hydroxyalkane sulfonate is inside the alkane chain, and the double bond of the olefin sulfonate is inside the olefin chain. The resulting product contains mainly a mixture of these, and may contain, in some cases, a trace amount of a hydroxyalkane sulfonate having a hydroxy group at the end of its carbon chain or an olefin sulfonate having a double bond at the end of its carbon chain.

In the present specification, each of these products and a mixture thereof are collectively referred to as "internal olefin sulfonate (component (A)). In addition, "hydroxyalkane sulfonate" is referred to as "hydroxy form of internal olefin sulfonate" (hereinafter also referred to as "HAS"), and "olefin sulfonate" as "olefin form of internal olefin sulfonate" (hereinafter also referred to "IOS").

The mass ratio of the compound in component (A) can be measured by high performance liquid chromatography mass spectrometer (hereinafter abbreviated as HPLC-MS). Specifically, the mass ratio can be determined from the HPLC-MS peak area of component (A).

An internal olefin sulfonates is known as a detergent base. An internal olefin used as a raw material for an internal olefin sulfonate can be obtained, for example, by isomerizing a 1-olefin obtained by dehydrating a 1-alcohol, but it is not easy to control the position of a double bond. The internal olefins different in the distribution of a double bond position are produced due to the variation in production conditions, and detergent compositions containing internal olefin sulfonates obtained by sulfonating them may be different in quality such as a detergent property, and it is a problem for manufacturers who are required to provide detergent compositions having a certain quality to users.

The present inventors have found that the change in the content of an internal olefin having a double bond at position 5 or higher used as a raw material causes a change in the detergent property of a detergent composition containing the resulting internal olefin sulfonate.

Examples of the salt of the internal olefin sulfonate include an alkali metal salt, an alkaline earth metal (½ atom) salt, an ammonium salt or an organic ammonium salt. Examples of the alkali metal salt include a sodium salt and a potassium salt. Examples of the organic ammonium include an alkanolammonium salt having 2 or more and 6 or less carbon atoms. From the viewpoint of versatility, the salt of internal olefin sulfonate is preferably an alkali metal salt, and more preferably a sodium salt and a potassium salt.

As is clear from the above-mentioned production method, the sulfonate group of the internal olefin sulfonate of component (A) is present inside the carbon chain, that is, the olefin chain or the alkane chain of the internal olefin sulfonate, and a trace amount of the internal olefin sulfonate having the sulfonate group at the end of its carbon chain may be, in some cases, contained. In the present invention, from the viewpoint of improving the detergent property against stains attached to textile products, the content of an internal olefin sulfonate having 15 or more and 24 or less carbon atoms with the sulfonate group at position 2 in component (A) is preferably 10% by mass or more, more preferably 15% by mass or more, further preferably 20% by mass or more, furthermore preferably 25% by mass or more, furthermore preferably 30% by mass or more, furthermore preferably 35% by mass or more and furthermore preferably 40% by mass or more, and preferably 60% by mass or less in component (A).

From the viewpoint of washing off more stains attached to textile products, the content of an internal olefin sulfonate having 15 or more and 24 or less carbon atoms with the sulfonate group at position 5 or higher in component (A) is preferably 60% by mass or less, more preferably 57% by mass or less, further preferably 54% by mass or less, furthermore preferably 50% by mass or less, furthermore preferably 46% by mass or less, furthermore preferably 42% by mass or less and furthermore preferably 35% by mass or less, and preferably 5% by mass or more and more preferably 10% by mass or more.

The content of each of compounds having a sulfonate group at different positions in component (A) can be measured by HPLC-MS. In the present specification, the content of each of compounds with a sulfonate group at different positions will be determined as the mass ratio of the compound with a sulfonate group at each position in a11 HAS forms of component (A), based on the HPLC-MS peak area. Here, HAS is a hydroxyalkane sulfonate, i.e., a hydroxy form of internal olefin sulfonate, among compounds produced by sulfonating an internal olefin sulfonate.

The content of the olefin sulfonate having 15 or more and 24 or less carbon atoms with the sulfonate group at position 1 in component (A) is, from the viewpoint of washing off more stains attached to textile products even when the temperature of the water used for washing is a low temperature of 0° C. or more and 15° C. or less, preferably 10% by mass or less, more preferably 7% by mass or less, further preferably 5% by mass or less and furthermore preferably 3% by mass or less, and from the viewpoint of reducing production cost and improving productivity, preferably 0.01% by mass or more in component (A).

The position of the sulfonate group in these compounds is the position in the olefin chain or the alkane chain.

In the present invention, an internal olefin sulfonate having 15 or more and 24 or less carbon atoms with the sulfonate group at position 5 or higher refers to a sulfonate having 15 or more and 24 or less carbon atoms with the sulfonate group at position 5 or higher among HAS forms having 15 or more and 24 or less carbon atoms. The same applies to an olefin sulfonate having 15 or more and 24 or less carbon atoms with the sulfonate group at position 1 or 2.

The internal olefin sulfonate can be a mixture of the hydroxy form and the olefin form. The mass ratio (olefin form/hydroxy form) of the content of the olefin form of internal olefin sulfonate to the content of the hydroxy form of internal olefin sulfonate in component (A) can be 0/100 or more and further 5/95 or more, and 50/50 or less, further 40/60 or less, further 30/70 or less and further 25/75 or less.

The mass ratio of the content of the olefin form of internal olefin sulfonate to the content of the hydroxy form of internal olefin sulfonate in component (A) can be determined by separating the hydroxy form and the olefin form by high performance liquid chromatography (HPLC), subjecting each of them to mass spectrometer (MS) to identify them and calculating the percentage of each form from the HPLC-MS peak area obtained.

Component (A) can be produced by sulfonating, neutralizing and hydrolyzing an internal olefin having 15 or more and 24 or less carbon atoms as a raw material. As an example of the sulfonation reaction, it can be carried out by allowing 1.0 to 1.2 mol of sulfur trioxide gas to react with 1 mol of the internal olefin. The reaction can be carried out at a reaction temperature of 20 to 40° C.

The neutralization is carried out, for example, by allowing an aqueous solution of alkali such as sodium hydroxide, ammonia or 2-aminoethanol to react with the sulfonate group in an amount of 1.0 to 1.5 molar times the theoretical value of the sulfonate group. The hydrolysis reaction may be carried out, for example, at 90 to 200° C. for 30 minutes to 3 hours in the presence of water. These reactions can be carried out continuously. After completion of the reaction, purification can be carried out by extraction, washing or the like.

In producing internal olefin sulfonate (A), sulfonation, neutralization and hydrolysis processes may be carried out using an internal olefin having a distribution of 15 or more and 24 or less carbon atoms as a raw material; sulfonation, neutralization and hydrolysis processes may be carried out using an internal olefin having a single number of carbon atoms as a raw material; or if necessary, plural types of internal olefin sulfonate having different numbers of carbon atoms which have previously been produced may be mixed.

In the present invention, the internal olefin refers to an olefin having a double bond inside the olefin chain as described above. The number of carbon atoms of the internal olefin of component (A) is 15 or more and 24 or less. The internal olefin used in component (A) may be used alone or in combination of two or more.

The total content of an olefin having a double bond at position 1, so-called alpha-olefin in internal olefin as a raw material is, from the viewpoint of further reducing an adsorption amount of the surfactant to fibers preferably 10% by mass or less, more preferably 7% by mass or less, further preferably 5% by mass or less and furthermore preferably 3% by mass or less, and from the viewpoint of reducing production cost and improving productivity, preferably 0.01% by mass or more.

The content of the olefin having a double bond at position 5 or higher in an internal olefin as a raw material is, from the viewpoint of further improving the detergent property against stains attached to fibers, preferably 60% by mass or less, more preferably 57% by mass or less, further preferably 54% by mass or less, furthermore preferably 50% by mass or less, furthermore preferably 46% by mass or less, furthermore preferably 42% by mass or less and furthermore preferably 35% by mass or less, and from the viewpoint of further reducing the amount of the surfactant adsorbed to fibers after washing, preferably 10% by mass or more, more preferably 12% by mass or more, further preferably 15% by mass or more, furthermore preferably 20% by mass or more and furthermore preferably 25% by mass or more. The highest position at which the double bond occurs in the internal olefin as a raw material varies depending on the number of carbon atoms.

Distribution of a double bond in the olefin as a raw material can be measured, for example, by gas chromatograph mass spectrometer (hereinafter abbreviated as GC-MS). Specifically, each component different in the carbon chain length and the double bond position is precisely separated from each other by a gas chromatograph analyzer (hereinafter abbreviated as GC), and each component can be subjected to a mass spectrometer (hereinafter abbreviated as MS) to identify the double bond position, and the percentage of each component can be determined from its GC peak area.

<Component (B)>

Component (B) is a nonionic surfactant having an HLB of more than 10.5 and 19 or less. A preferred component (B) is a nonionic surfactant containing a polyoxyethylene group and having an HLB of more than 10.5 and 19 or less. From the viewpoint of further reducing the adsorption amount of the surfactant to textile products after washing, the HLB of component (B) to be blended in the present invention is preferably 11 or more, more preferably 12 or more, further preferably 12.5 or more, furthermore preferably 13 or more, furthermore preferably 14 or more, furthermore preferably 15 or more and furthermore preferably 16 or more, and 19 or less.

The value of the HLB of the nonionic surfactant in the present invention refers to an HLB calculated by the following formula when the nonionic surfactant contains polyoxyethylene group. The average molecular weight of the polyoxyethylene group refers to the average molecular weight calculated from the average mole number added when the number of moles of added oxyethylene group has a distribution. The average molecular weight of component (B) refers to the molecular weight calculated as an average value when a hydrophobic group such as a hydrocarbon group has a distribution or the number of moles of added polyoxyethylene group has a distribution.

HLB=[(average molecular weight of polyoxyethylene group)/[average molecular weight of component(*B*)]]×20

Hereinafter, specific nonionic surfactants will be illustrated, but the above-mentioned "oxyethylene group" may be sometimes referred to as "ethyleneoxy group".

In the present invention, when the nonionic surfactant contains no polyoxyethylene group, the HLB of the nonionic surfactant refers to a value measured according to the method of Kunieda et al. described in "Journal of Colloid and Interface Science, Vol. 107, No. 1, September 1985". This document describes a measurement method of an HLB based on the finding that there is a linear relationship between a particular temperature (THLB) and the number of HLB by Griffin.

Component (B) is suitably a nonionic surfactant having an HLB of more than 10.5 and 19 or less and is represented by the following general formula (b1):

$$R^1(CO)_mO\text{-}(A^1O)_n\text{—}R^2 \quad \text{(b1)}$$

wherein $R^1$ is an aliphatic hydrocarbon group having 9 or more and 18 or less carbon atoms, $R^2$ is a hydrogen atom or a methyl group, CO is a carbonyl group, m is 0 or 1, $A^1O$ group is one or more groups selected from an ethyleneoxy group and a propyleneoxy group, and n is an average number of added moles and is 6 or more and 50 or less.

In the general formula (b1), $R^1$ is an aliphatic hydrocarbon group having 9 or more and 16 or less carbon atoms. The value of the HLB is lower as the number of carbon atoms of $R^1$ is more and is higher as the number of carbon atoms of $R^1$ is less. The number of carbon atoms of $R^1$ is, from the viewpoint of further reducing the adsorption amount of the surfactant to textile products after washing, preferably 12 or more, more preferably 12.5 or more and further preferably 13.0 or more, and from the viewpoint of allowing the stains attached to fibers to be easily removed, 16 or less and preferably 15 or less. The aliphatic hydrocarbon group of $R^1$ is preferably a group selected from an aliphatic alkyl group and an aliphatic alkenyl group. The number of carbon atoms of $R^1$ may be the average number of carbon atoms.

In the general formula (b1), the $A^1O$ group is one or more groups selected from an ethyleneoxy group and a propyleneoxy group. When an ethyleneoxy group and a propyleneoxy group are contained, the ethyleneoxy group and the propyleneoxy group may be bonded in block type or random type. From the viewpoint of further reducing the adsorption amount of the surfactant to textile products after washing, the $A^1O$ group is preferably a group containing an ethyleneoxy group. The value of the HLB is higher as the percentage of ethyleneoxy group in the $A^3O$ group is higher.

In the general formula (b1), n is an average number of added moles, and is 6 or more and 50 or less. The value of the HLB is higher as the number of n is more and is lower as the number of n is less. From the viewpoint of further reducing the adsorption amount of the surfactant to textile products after washing, n is 6 or more, preferably 6.5 or more, more preferably 7 or more, further preferably 8 or more, furthermore preferably 9 or more, furthermore preferably 10 or more and furthermore preferably 12 or more, and from the viewpoint of the detergent property against stains attached to fibers, n is 50 or less, preferably 45 or less, more preferably 40 or less, further preferably 35 or less, furthermore preferably 26 or less and furthermore preferably 24 or less.

<Composition and Others>

The total content of the content of component (A) and the content of component (B) in the detergent composition for fibers of the present invention is, from the viewpoint of further improving the detergent property per mass of the detergent composition for textile products during washing of fibers, preferably 4% by mass or more, more preferably 5% by mass or more, further preferably 6% by mass or more, furthermore preferably 7% by mass or more, furthermore preferably 8% by mass or more and furthermore preferably 9% by mass or more; and from the viewpoint of blending cost, preferably 70% by mass or less, more preferably 60% by mass or less and further preferably 50% by mass or less.

The content of component (A) contained in the detergent composition for fibers is based on the value calculated assuming that the counter ion is a sodium ion. That is the content in terms of a sodium salt.

In the detergent composition for fibers of the present invention, in terms of further improving the detergent property against stains attached to fibers per mass of the detergent composition for textile products and further reducing the adsorption amount of the surfactant to textile products, or in the method for producing a detergent composition for textile products, in terms of keeping constant the detergency against stains attached to textile products even if the content of the internal olefin having a double bond in position 5 or higher in the internal olefin as a raw material for component (A) is changed, the mass ratio (B)/(A) of the content of component (B) to the content of component (A) is more than 0, preferably 0.05 or more, more preferably 0.08 or more, further preferably 0.1 or more, furthermore preferably 0.15 or more, furthermore preferably 0.2 or more, furthermore preferably 0.25 or more, furthermore preferably 0.3 or more, furthermore preferably 0.35 or more and furthermore preferably 0.40 or more, and preferably 9 or less, more preferably 8 or less, further preferably 7 or less, furthermore preferably 6 or less and furthermore preferably 5 or less.

The total of the content of component (A) and the content of component (B) in a11 surfactants in the detergent composition for textile products of the present invention is preferably 60% by mass or more and 100% by mass or less.

As an example of surfactants other than component (A) and component (B), for example, component (C) described with respect to an optional component to be described below can be used. The mass of component (C), which is an anionic surfactant, represents the mass obtained by replacing the counter ion with a sodium ion. On the other hand, the mass of component (C), which is a cationic surfactant, represents the mass obtained by replacing the counter ion with a chloride ion.

From the viewpoint of further reducing the amount of the surfactant adsorbed to textile products after washing, the total of the content of component (A) and the content of component (B) in a11 surfactants in the detergent composition for textile products is preferably 60% by mass or more, more preferably 70% by mass or more, further preferably 80% by mass or more, furthermore preferably 90% by mass or more and furthermore preferably 95% by mass or more, and it may be even 100% by mass.

<Fibers>

The fiber constituting textile products to be washed with the detergent composition for textile products of the present invention may be either a hydrophobic fiber or a hydrophilic fiber. Examples of the hydrophobic fiber include a protein-based fiber (such as cow milk protein casein fiber or promix), a polyamide-based fiber (such as nylon), a polyester-based fiber (such as polyester), a polyacrylonitrile-based fiber (such as acrylic), a polyvinyl alcohol-based fiber (such as vinylon), a polyvinyl chloride-based fiber (such as polyvinyl chloride), a polyvinylidene chloride-based fiber (such as vinylidene), a polyolefin-based fiber (such as polyethylene or polypropylene), a polyurethane-based fiber (such as polyurethane), a polyvinyl chloride/polyvinyl alcohol copolymer-based fiber (such as polychlal), a polyalkylene paraoxybenzoate-based fiber (such as benzoate), a polyfluoroethylene-based fiber (such as polytetrafluoroethylene), a glass fiber, a carbon fiber, an alumina fiber, a silicon carbide fiber, a rock fiber, a slag fiber and a metal fiber (a gold thread, a silver thread or a steel fiber). Examples of the hydrophilic fiber include a seed hair fiber (such as cotton, arboreous cotton or kapok), a bast fiber (such as linen, flax, ramie, hemp or jute), vein fiber (such as manila hemp or sisal hemp), coconut fiber, rush, straw, an animal hair fiber (such as wool, mohair, cashmere, camel hair, alpaca, vicuna or angora), a silk fiber (domesticated silkworm silk or wild silkworm silk), a feather and down and a cellulosic fiber (such as rayon, polynosic, cupra or acetate).

From the viewpoint that by using the detergent composition for textile products of the present invention, the effect of reducing the amount of the surfactant adsorbed to fibers after washing is more easily felt than by using conventionally known detergent compositions, fibers are preferably textile products containing cotton fibers.

<Textile Product>

In the present invention, the textile product refers to a cloth produced by using the above-mentioned hydrophobic fiber or hydrophilic fiber such as a woven fabric, a knitted fabric or a nonwoven fabric, and a product obtained by using the cloth such as an undershirt, a T-shirt, a business shirt, a blouse, pants, a hat, a handkerchief, a towel, a knit, socks, an underwear or tights. From the viewpoint that the softness of fibers after washing with the detergent composition for textile products of the present invention is more easily felt, the textile product is preferably a textile product containing a cotton fiber. From the viewpoint of further improving the softness of fibers, the content of the cotton fiber in the textile product is preferably 5% by mass or more, more preferably 10% by mass or more, further preferably 15% by mass or more, furthermore preferably 20% by mass or more and furthermore preferably 100% by mass or more.

<Component (C): Surfactants Other than Component (A)>

Surfactants other than component (A) can be used as component (C) in the detergent composition for textile products of the present invention, as long as they do not interfere with the effect of the present invention. Examples of component (C) include one or more anionic surfactants selected from the following component (c1), component (c2), component (c3) and component (c4):

component (c1): alkyl or alkenyl sulfate, component (c2): polyoxyalkylene alkyl ether sulfate or polyoxyalkylene alkenyl ether sulfate, component (c3): an anionic surfactant having a sulfonate group (except for component (A)), and component (c4): a fatty acid or a salt thereof. Example of component (C) other than those described above include component (c5) which is a nonionic surfactant having a hydroxy group or polyoxyalkylene group.

Specific examples of component (c1) include one or more anionic surfactants selected from alkyl sulfates having an alkyl group having 10 or more and 18 or less carbon atoms and alkenyl sulfates having an alkenyl group having 10 or more and 18 or less carbon atoms. From the viewpoint of improving the detergent property, component (c1) is preferably one or more anionic surfactants selected from alkyl sulfates having an alkyl group having 12 or more and 14 or less carbon atoms, and more preferably one or more anionic surfactants selected from sodium alkyl sulfates having an alkyl group having 12 or more and 14 or less carbon atoms.

Specific examples of component (c2) include one or more anionic surfactants selected from a polyoxyalkylene alkyl sulfate having an alkyl group having 10 or more and 18 or less carbon atoms and having an average number of moles of added alkylene oxide of 1 or more and 3 or less, and a polyoxyalkylene alkenyl ether sulfate having an alkenyl group having 10 or more and 18 or less carbon atoms and having an average number of moles of added alkylene oxide of 1 or more and 3 or less. From the viewpoint of improving the detergent property, component (c2) is preferably a polyoxyethylene alkyl sulfate having an average number of moles of added ethylene oxide of 1 or more and 2.2 or less, more preferably a polyoxyethylene alkyl sulfate having an alkyl group having 12 or more and 14 or less carbon atoms and having an average number of moles of added ethylene oxide of 1 or more and 2.2 or less, and further preferably a sodium salt thereof.

An anionic surfactant having a sulfonate group as component (c3) refers to an anionic surfactant having a sulfonate as a hydrophilic group (except for component (A)).

Specific examples of component (c3) include one or more anionic surfactants selected from an alkylbenzene sulfonate having an alkyl group having 10 or more and 18 or less carbon atoms, an alkenylbenzene sulfonate having an alkenyl group having 10 or more and 18 or less carbon atoms, an alkane sulfonate having an alkyl group having 10 or more and 18 or less carbon atoms, an α-olefin sulfonate having an α-olefin moiety having 10 or more and 18 or less carbon atoms, an α-sulfofatty acid salt having a fatty acid moiety having 10 or more and 18 or less carbon atoms, an α-sulfofatty acid lower alkyl ester salt having a fatty acid moiety having 10 or more and 18 or less carbon atoms and an ester moiety having 1 or more and 5 or less carbon atoms, and an internal olefin sulfonate having 12 or more and 14 or less carbon atoms. From the viewpoint of improving the detergent property, component (c3) is preferably an alkylbenzene sulfonate having an alkyl group having 11 or more and 14 or less carbon atoms, and more preferably a sodium alkylbenzene sulfonate having an alkyl group having 11 or more and 14 or less carbon atoms.

Examples of a fatty acid or a salt thereof as component (c4) include a fatty acid or a salt thereof having 10 or more and 20 or less carbon atoms. From the viewpoint of further increasing the effect of softening fibers of component (A), the number of carbon atoms of component (c4) is 10 or more, preferably 12 or more and more preferably 14 or more, and 20 or less and preferably 18 or less.

The salt of an anionic surfactant as components (c1) to (c4) is preferably an alkali metal salt, more preferably a sodium salt or a potassium salt, and further preferably a sodium salt.

[Component (D): Alkali Agent]

The detergent composition for textile products of the present invention can contain an alkali agent as component (D) from the viewpoint of further improving the detergent property against stains attached to fibers. Specific examples of the alkali agent can include one or more inorganic alkali agents selected from sodium carbonate, potassium carbonate, sodium sesquicarbonate and sodium hydrogen carbonate. The inorganic alkali agent is preferably one or more alkali agents selected from sodium carbonate and potassium carbonate, and more preferably sodium carbonate. Examples of the alkali agent other than those described above can include an alkanolamine in which among the groups bonded to a nitrogen atom, one or more and three or less groups are alkanol groups having 2 or more and 4 or less carbon atoms and the remainder is an alkyl group having 1 or more and 4 or less carbon atoms or a hydrogen atom. Among them, the alkanol group of the alkanolamine is preferably a hydroxyalkyl group and further preferably a hydroxyethyl group. Except for the alkanol group, a hydrogen atom or methyl group is preferred, and a hydrogen atom is particularly preferred. Examples of the alkanolamine include an alkanolamine such as 2-aminoethanol, N-methylethanolamine, N,N-dimethylethanolamine, N,N-diethylethanolamine, diethanolamine, N-methyldiethanolamine and triethanolamine. In the present invention, component (D) is preferably an alkanolamine selected from monoethanolamine and triethanolamine and more preferably monoethanolamine.

<Component (E)>

The detergent composition for textile products of the present invention can further contain an organic solvent having one or more hydroxy groups as component (E).

Examples of the organic solvent having one or more hydroxy groups include one or more organic solvents selected from monohydric or higher and hexahydric or lower alcohols having an aliphatic hydrocarbon group having 2 or more and 6 or less carbon atoms such as ethanol, 1-propanol, 2-propanol, ethylene glycol, propylene glycol, butylene glycol, 2-methyl-2,4-pentanediol, 1,5-pentanediol, 1,6-hexanediol, glycerin or 2-methyl-2,4-pentanediol.

<Water>

In order to bring the detergent composition for textile products of the present invention into a liquid state at 4° C. or more and 40° C. or less, water can be contained therein. Water to be used can be deionized water (sometimes also referred to as ion-exchanged water) or ion-exchanged water having sodium hypochlorite added at 1 mg/kg or more and 5 mg/kg or less thereto. Tap water can be also used.

In the detergent composition for fibers of the present invention, the content of water is preferably 4% by mass or more and more preferably 5% by mass or more, and preferably 85% by mass or less and more preferably 80% by mass or less.

In addition to these components, the following components (f1) to (f7) may be blended into the detergent composition for textile products of the present invention:

(f1) 0.01% by mass or more and 10% by mass or less of an anti-stain redeposition agent and a dispersing agent such as polyacrylic acid, polymaleic acid or carboxymethyl cellulose, (f2) 0.01% by mass or more and 10% by mass or less of a bleaching agent such as hydrogen peroxide, sodium percarbonate or sodium perborate, (f3) 0.01% by mass or more and 10% by mass or less of a bleaching activator such as tetraacetylethylenediamine or bleaching activators represented by the general formulas (I-2) to (I-7) described in JP-A 6-316700, (f4) 0.001% by mass or more, preferably 0.01% by mass or more, more preferably 0.1% by mass or more and further preferably 0.3% by mass or more, and 2% by mass or less and preferably 1% by mass or less of one or more enzymes selected from cellulase, amylase, pectinase, protease and lipase and preferably one or more enzymes selected from amylase and protease, (f5) 0.001% by mass or more and 1% by mass or less of a fluorescent dye such as a fluorescent dye commercially available as Tinopal CBS (trade name, manufactured by Ciba Specialty Chemicals) or Whitex SA (trade name, manufactured by Sumitomo Chemical Co., Ltd.), (f6) 0.01% by mass or more and 2% by mass or less of an antioxidant such as butylhydroxytoluene, distyrenated cresol, sodium sulfite or sodium hydrogen sulfite, and (f7) an appropriate amount of a pigment, a perfume, an antimicrobial preservative or a defoaming agent such as silicone.

From the viewpoint of further improving the detergent performance against stains attached to fibers, the pH of the detergent composition for fibers of the present invention at 20° C. is preferably 3 or more and more preferably 3.5 or more, and preferably 9 or less and more preferably 8 or less.

[Method for Washing Textile Products]

The method for washing fibers of the present invention is a method for washing textile products with a detergent liquid containing component (A), component (B) and water, wherein the hardness of the detergent liquid is more than 0° dH.

In the method for washing textile products of the present invention, the detergent liquid is preferably one obtained by using the detergent composition for textile products of the present invention.

The matters described with respect to the detergent composition for textile products of the present invention can be appropriately applied to a method for washing textile products of the present invention.

The method of washing textile products of the present invention allows more stains attached to textile products to be washed off by using a detergent liquid having a hardness exceeding 0° dH. From the viewpoint of further improving the detergent property against stains attached to textile products, the hardness of the detergent liquid is, by German hardness, preferably 0.5° dH or more, more preferably 1° dH or more, further preferably 2° dH or more and furthermore preferably 3° dH or more, and preferably 20° dH or less, more preferably 10° dH or less, further preferably 8° dH and furthermore preferably 6° dH or less.

The German hardness (° dH) used in the present specification refers to the concentrations of calcium and magnesium in water expressed as the concentration expressed in terms of $CaCO_3$:1 mg/L (ppm)=about 0.056° dH (1° dH=17.8 ppm).

The concentrations of calcium and magnesium for this German hardness are determined by a chelate titration method using disodium ethylenediaminetetraacetate salt.

A specific method for measuring the German hardness of water in the present specification is shown as follows.

<Method for Measuring German Hardness of Water>

[Reagent]

- 0.01 mol/1 EDTA.2Na solution: a 0.01 mol/1 aqueous solution of disodium ethylenediaminetetraacetate (a titration solution, 0.01 M EDTA-Na2, manufactured by SIGMA-ALDRICH)
- Universal BT indicator (product name: Universal BT, manufactured by Dojindo Laboratories)
- Ammonia buffer solution for hardness measurement (a solution prepared by dissolving 67.5 g of ammonium chloride in 570 ml of 28 w/v % ammonia water and adding ion-exchanged water until the total volume is 1000 ml) [Measurement of hardness]

(1) 20 ml of water serving as a sample is collected in a conical beaker with a whole pipette.

(2) 2 ml of an ammonia buffer solution for hardness measurement is added thereto.

(3) 0.5 ml of Universal BT indicator is added thereto. It is made sure that the solution after addition is reddish violet.

(4) While shaking the conical beaker well, a 0.01 mol/1 EDTA.2Na solution is added dropwise thereto from a burette, and the point at which the sample water turns blue is taken as the end point of the titration.

(5) The total hardness is determined by the following calculation formula:

$$\text{Hardness}(^\circ\ \text{dH})=T\times 0.01\times F\times 56.0774\times 100/A$$

wherein:

T: Titer of a 0.01 mol/1 EDTA.2Na solution (mL),

A: Sample volume (20 mL, a volume of sample water), and

F: Factor of a 0.01 mol/1 EDTA.2Na solution.

When component (A), component (B) and an optional component are mixed with water having a hardness exceeding 0° dH and preferably water having a hardness in the above-mentioned range, without the use of a component to supplement the hardness component, the hardness of the detergent liquid will usually exceed 0° dH. Therefore, the detergent liquid to be used in the present invention may be one obtained by mixing component (A) and component (B) with water having a hardness exceeding 0° dH, without the use of a component to supplement the hardness component.

The content of component (A) in the detergent liquid is preferably 0.005% by mass or more and more preferably 0.01% by mass or more, and preferably 1.0% by mass or less and more preferably 0.8% by mass or less.

The content of component (B) in the detergent liquid is preferably 0.001% by mass or more and more preferably 0.002% by mass or more, and preferably 5.0% by mass or less and more preferably 1.0% by mass or less.

The mass ratio (B)/(A) of component (B) to component (A) in the detergent liquid can be preferably selected from the range described with respect to the detergent composition for textile products of the present invention.

From the viewpoint of further reducing the amount of the surfactant adsorbed to textile products after washing, the total of the content of component (A) and the content of component (B) in a11 surfactants in the detergent liquid is 60% by mass or more, preferably 70% by mass or more, more preferably 80% by mass or more, further preferably 90% by mass or more and furthermore preferably 95% by mass or more, and it may be even 100% by mass.

From the viewpoint of further improving the detergent property against stains attached to fibers, the temperature of the detergent liquid is preferably 0° C. or more, more preferably 3° C. or more and further preferably 5° C. or more, and preferably 40° C. or less and more preferably 35° C. or less.

The pH of the detergent liquid at 20° C. is, from the viewpoint of further improving the detergent property against stains attached to fibers, preferably 3 or more and more preferably 4 or more, and preferably 10 or less and more preferably 9 or less. The pH can be measured by the following measurement method.

<pH Measurement Method>

A pH measuring composite electrode (glass fitting sleeve-type, manufactured by HORIBA, Ltd.) is connected to a pH meter (pH/ion meter F-23, manufactured by HORIBA, Ltd.) and the power is turned on. A saturated potassium chloride aqueous solution (3.33 mol/L) is used as an internal liquid for pH electrode. Next, each of a pH 4.01 standard solution (a phthalate standard solution), a pH 6.86 standard solution (a neutral phosphate standard solution) and a pH 9.18 standard solution (a borate standard solution) is filled in a 100 mL beaker, and immersed in a thermostat bath at 25° C. for 30 minutes. The pH measuring electrode is immersed for 3 minutes in each of the standard solutions adjusted to a constant temperature, and subjected to calibration operation in the order of pH 6.86 pH→9.18→pH 4.01. Each of samples to be measured is adjusted to 25° C., the electrode of the pH meter is immersed in the sample, and the pH after 1 minute is measured.

Recently, washing machines have become larger and the value of the bath ratio expressed as the ratio of the amount of water (liter) in a detergent liquid to the mass (kg) of clothing, that is, the amount of water (liter) in a detergent liquid/the mass (kg) of clothing (hereinafter also referred to "bath ratio") tends to decrease. When using a household washing machine, the smaller bath ratio sometimes leads to the increase in the amount of the surfactant adsorbed to textile products during washing. According to the method for washing clothing of the present invention, the amount of the surfactant adsorbed to textile products at washing can be reduced even under washing conditions of a small bath ratio. From the viewpoint of reducing the amount of the surfactant adsorbed to textile products at washing while keeping detergency against stains attached to textile products, the bath ratio is preferably 2 or more, more preferably 3 or more, further preferably 4 or more and furthermore preferably 5 or more, and preferably 45 or less, more preferably 40 or less, further preferably 30 or less and furthermore preferably 20 or less.

According to the method for washing textile products of the present invention, fibers can be finished more softly even with a short washing time. The washing time is, from the viewpoint of allowing stains attached to fibers to be easily removed or finishing fibers more softly, preferably 1 minute or more, more preferably 2 minutes or more and further preferably 3 minutes or more, and from the viewpoint of finishing fibers more softly, preferably 1 hour or less, more preferably 30 minutes or less, further preferably 20 minutes or less and furthermore preferably 15 minutes or less.

The method for washing textile products of the present invention is suitable for a rotary washing method. The rotary washing method refers to a washing method in which fibers not fixed to a rotating device rotate together with the detergent liquid around the rotation axis. The rotary washing method can be carried out by a rotary type washing machine. Therefore, in the present invention, fibers are preferably washed by using a rotary type washing machine for the viewpoint of finishing the fibers more softly. Specific examples of the rotary type washing machine include a drum type washing machine, a pulsator type washing machine or an agitator type washing machine. As these rotary type washing machines, machines commercially available for household can be used, respectively. The drum type washing machines, which have been recently widespread rapidly because the amount of water used for one washing can be further reduced, can reduce the amount of water particularly at washing. The method for washing textile products of the present invention is preferably a method for washing textile products using a drum type washing machine, in that it can further enjoy the effect of the present invention.

<Method for Producing a Detergent Composition for Textile Products>

The method for producing a detergent composition for textile products of the present invention is a method for producing a detergent composition for textile products, including mixing component (A) and component (B):

component (A): an internal olefin sulfonate having 15 or more and 24 or less carbon atoms and including an internal olefin sulfonate having 15 or more and 24 or less carbon atoms with the sulfonate group at position 5 or higher, and component (B): a nonionic surfactant having an HLB of more than 10.5 and 19 or less.

According to the method for producing a detergent composition for textile products of the present invention, it is possible to provide a detergent composition for textile products in which a surfactant is less likely to adsorb to fibers after washing.

According to the method for producing a detergent composition for textile products of the present invention, for example, even if the content of the internal olefin having a double bond at position 5 or higher is changed, in the internal olefin having 15 to 24 carbon atoms as a raw material, it is possible to provide a detergent composition for textile products which can provide a constant detergency against stains attached to textile products.

In addition, by using component (A) and component (B) in combination, it is possible to provide a detergent composition for textile products in which a surfactant is less likely to adsorb to fibers after washing.

The matters described with respect to a detergent composition for fibers and a method for washing textile products according to the present invention can be appropriately applied to a method for producing a detergent composition for textile products of the present invention.

Component (A) is an internal olefin sulfonate having 15 or more and 24 or less carbon atoms and including an internal olefin sulfonate having 15 or more and 24 or less carbon atoms with the sulfonate group at position 5 or higher. Component (A) may be an internal olefin sulfonate obtained by using an internal olefin including an internal olefin having a number of carbon atoms of 15 or more and 24 or less with a double bond at position 5 or higher as a raw material.

The content of the olefin with a double bond at position 5 or higher in an internal olefin as a raw material is, from the viewpoint of further improving the detergent property against stains attached to fibers, preferably 60% by mass or less, more preferably 57% by mass or less, further preferably 54% by mass or less, furthermore preferably 50% by mass or less, furthermore preferably 46% by mass or less, furthermore preferably 42% by mass or less and furthermore preferably 35% by mass or less, and from the viewpoint of further reducing the amount of the surfactant adsorbed to fibers after washing, preferably 10% by mass or more, more preferably 12% by mass or more, further preferably 15% by mass or more, furthermore preferably 20% by mass or more and furthermore preferably 25% by mass or more.

In the method for producing a detergent composition for textile products of the present invention, it is possible to mix component (A), component (B), and "water" which is an optional component of the above-mentioned detergent composition for textile products.

Component (A) is suitably mixed so that the total content of the content of component (A) and the content of component (B) in the detergent composition for textile products produced is, from the viewpoint of further improving the detergent property per mass of the detergent composition for textile products, preferably 4% by mass or more, more preferably 5% by mass or more, further preferably 6% by mass or more, furthermore preferably 7% by mass or more, furthermore preferably 8% by mass or more and furthermore preferably 9% by mass or more, and from the viewpoint of blending cost, preferably 70% by mass or less, more preferably 60% by mass or less and further preferably 50% by mass or less.

The content of component (A) contained in the detergent composition for fibers is based on the value calculated assuming that the counter ion is a sodium ion.

In terms of further improving the detergent property against stains attached to fibers per mass of the detergent composition for textile products, further reducing the amount of the surfactant adsorbed to textile products, or in the method for producing a detergent composition for textile products, in terms of keeping constant the detergency against stains attached to textile products even if the content of the internal olefin having a double bond in position 5 or higher in the internal olefin as a raw material for component (A) is changed, component (A) and component (B) is suitably mixed so that the mass ratio (B)/(A) of the content of component (B) to the content of component (A) in the detergent composition for textile products produced is more than 0, preferably 0.05 or more, more preferably 0.08 or more, further preferably 0.1 or more, furthermore preferably 0.15 or more, furthermore preferably 0.2 or more, furthermore preferably 0.25 or more, furthermore preferably 0.3 or more, furthermore preferably 0.35 or more and furthermore preferably 0.40 or more, and preferably 9 or less, more preferably 8 or less, further preferably 7 or less, furthermore preferably 6 or less and furthermore preferably 5 or less.

Component (A) and component (B) is suitably mixed so that the total of the content of component (A) and the content of component (B) in a11 surfactants in the detergent composition for textile products produced is preferably 60% by mass or more and 100% by mass or less.

As an example of surfactants other than component (A) and component (B), for example, component (C) described with respect to an optional component described above can be used. The mass of component (C), which is an anionic surfactant, represents the mass obtained by replacing the counter ion with a sodium ion. On the other hand, the mass of component (C), which is a cationic surfactant, represents the mass obtained by replacing the counter ion with a chloride ion.

From the viewpoint of further reducing the amount of the surfactant adsorbed to textile products after washing, component (A) and component (B) is suitably mixed so that the total of the content of component (A) and the content of component (B) in a11 surfactants in the detergent composition for textile products produced is preferably 60% by mass or more, more preferably 70% by mass or more, further preferably 80% by mass or more, furthermore preferably 90% by mass or more, furthermore preferably 95% by mass or more and furthermore preferably 100% by mass.

When mixing component (A), component (B) and water, component (A), component (B) and water may be introduced into a stirring vessel separately and then mixed, or mixture (1), which is obtained by previously mixing two components selected from component (A), component (B) and water, and the other component may be introduced into a stirring vessel and then mixed.

When introducing component (A), component (B) and water separately into a stirring vessel, component (A), component (B) and water may be introduced successively or simultaneously. In addition, the total amount of each component may be introduced at once or in divided portions.

When introducing mixture (1), which is obtained by previously mixing two components selected from component (A), component (B) and water, and the other component into a stirring vessel and then mixing them, mixture (1) and the other component may be introduced successively or simultaneously. In addition, the total amount of each component may be introduced at once or in divided portions.

The temperature of the mixture during mixing is not limited. For example, the temperature of the mixture can be a temperature of 5° C. or more and 70° C. or less, in terms of easier mixing.

Embodiments of the Present Invention

Embodiments of the present invention will be illustrated as follows. The matters described with respect to a liquid detergent composition for textile products and the method for producing a liquid detergent composition for textile products according to the present invention can be appropriately applied to these embodiments.

<1>

A detergent composition for textile products containing the following component (A) and component (B):

component (A): an internal olefin sulfonate having 15 or more and 24 or less carbon atoms and including an internal olefin sulfonate having 15 or more and 24 or less carbon atoms with the sulfonate group at position 5 or higher, and component (B): a nonionic surfactant having an HLB of more than 10.5 and 19 or less.

<2>

The detergent composition for textile products according to <1>, wherein component (B) is a nonionic surfactant containing a polyoxyethylene group and having an HLB of more than 10.5 and 19 or less.

<3>

The detergent composition for textile products according to <1> or <2>, wherein the HLB of component (B) is 11 or more, preferably 12 or more, more preferably 12.5 or more, further preferably 13 or more, furthermore preferably 14 or more, and 19 or less.

<4>

The detergent composition for textile products according to any of <1> to <3>, wherein component (B) is a nonionic surfactant represented by the following general formula (01):

$$R^1(CO)_mO\text{-}(A^1O)_n\text{—}R^2 \quad \text{(b1)}$$

wherein $R^1$ is an aliphatic hydrocarbon group having 9 or more and 18 or less carbon atoms, $R^2$ is a hydrogen atom or a methyl group, CO is a carbonyl group, m is 0 or 1, $A^1O$ group is one or more groups selected from an ethyleneoxy group and a propyleneoxy group, and n is an average number of added moles and is 6 or more and 50 or less.

<5>

The detergent composition for textile products according to <4>, wherein in the general formula (b1), the number of carbon atoms of $R^1$ is preferably 12 or more, more preferably 12.5 or more, further preferably 13.0 or more, and preferably 16 or less, and more preferably 15 or less.

<6>

The detergent composition for textile products according to <5> or <6>, wherein in the general formula (b1), the aliphatic hydrocarbon group of $R^1$ is a group selected from an aliphatic alkyl group and an aliphatic alkenyl group.

<7>

The detergent composition for textile products according to any of <4> to <6>, wherein in the general formula (b1), the $A^1O$ group is a group containing an ethyleneoxy group.

<8>

The detergent composition for textile products according to any of <4> to <7>, wherein in the general formula (b1), n is preferably 6.5 or more, more preferably 7 or more, further preferably 8 or more, furthermore preferably 9 or more, furthermore preferably 10 or more and furthermore preferably 12 or more, and 50 or less, preferably 45 or less, more preferably 40 or less, further preferably 35 or less, furthermore preferably 26 or less and furthermore preferably 24 or less.

<9>

The detergent composition for textile products according to any one of <1> to <8>, wherein component (A) is an internal olefin sulfonate having 15 or more and 24 or less carbon atoms and including 5% by mass or more and 60% by mass or less of an internal olefin sulfonate having 15 or more and 24 or less carbon atoms with the sulfonate group at position 5 or higher.

<10>

The detergent composition for textile products according to <9>, wherein the content of the internal olefin sulfonate having 15 or more and 24 or less carbon atoms with the sulfonate group at position 5 or higher in component (A) is more preferably 57% by mass or less, further preferably 54% by mass or less, furthermore preferably 50% by mass or less, furthermore preferably 46% by mass or less, furthermore preferably 42% by mass or less and furthermore preferably 35% by mass or less, and preferably 10% by mass or more.

<11>

The detergent composition for textile products according to any of <1> to <10>, wherein a mass ratio (B)/(A) of component (B) to component (A) is 0.05 or more and 9 or less.

<12>

The detergent composition for textile products according to <11>, wherein the mass ratio (B)/(A) of the content of component (B) to the content of component (A) is preferably 0.08 or more, more preferably 0.1 or more, further preferably 0.15 or more, furthermore preferably 0.2 or more, furthermore preferably 0.25 or more, furthermore preferably 0.3 or more, furthermore preferably 0.35 or more, furthermore preferably 0.40 or more, and preferably 8 or less, further preferably 7 or less, furthermore preferably 6 or less, and furthermore preferably 5 or less.

<13>

The detergent composition for textile products according to any one of <1> to <12>, wherein component (A) is one or more selected from the following component (a1) and component (a2), wherein a mass ratio (a2)/(a1) of component (a2) to component (a1) is 0 or more and 1 or less:

component (a1): an internal olefin sulfonate having 15 or more and 16 or less carbon atoms and including an internal olefin sulfonate having 15 or more and 16 or less carbon atoms with the sulfonate group at position 5 or higher, and component (a2): an internal olefin sulfonate having 17 or more and 24 or less carbon atoms and including an internal olefin sulfonate having 17 or more and 24 or less carbon atoms with the sulfonate group at position 5 or higher.

<14>

The detergent composition for textile products according to <13>, wherein the mass ratio (a2)/(a1) of component (a2) to component (a1) is 1 or less, preferably 0.95 or less, more preferably 0.9 or less, further preferably 0.8 or less, furthermore preferably 0.7 or less, furthermore preferably 0.6 or less, furthermore preferably 0.5 or less, furthermore preferably 0.4 or less, furthermore preferably 0.3 or less, furthermore preferably 0.2 or less, furthermore preferably 0.1 or less, furthermore preferably 0.05 or less and furthermore preferably 0.

<15>

The detergent composition for textile products according to any one of <1> to <14>, wherein the total of the content of component (A) and the content of component (B) in a11 surfactants in the detergent composition for textile products is 60% by mass or more and 100% by mass or less.

<16>

The detergent composition for textile products according to <15>, wherein the total of the content of component (A) and the content of component (B) in a11 surfactants in the detergent composition for textile products is preferably 70% by mass or more, further preferably 80% by mass or more, furthermore preferably 90% by mass or more and furthermore preferably 95% by mass or more, and 100% by mass or less or 100% by mass.

<17>

The detergent composition for textile products according to any one of <1> to <16>, further containing water.

<18>

A method for washing textile products with a detergent liquid containing the following component (A) and component (B), and water, wherein the hardness of the detergent liquid is more than 0° dH:

component (A): an internal olefin sulfonate having 15 or more and 24 or less carbon atoms and including an internal olefin sulfonate having 15 or more and 24 or less carbon atoms with the sulfonate group at position 5 or higher, and component (B): a nonionic surfactant having an HLB of more than 10.5 and 19 or less.

<19>

The method for washing textile products according to <18>, wherein the hardness of the detergent liquid is, by German hardness, preferably 0.5° dH or more, more preferably 1° dH or more, further preferably 2° dH or more and furthermore preferably 3° dH or more, and preferably 20° dH or less, more preferably 10° dH or less, further preferably 8° dH or less and furthermore preferably 6° dH or less.

<20>

A method for producing a detergent composition for textile products, including mixing the following component (A) and component (B):

component (A): an internal olefin sulfonate having 15 or more and 24 or less carbon atoms and including an internal olefin sulfonate having 15 or more and 24 or less carbon atoms with the sulfonate group at position 5 or higher, and component (B): a nonionic surfactant having an HLB of more than 10.5 and 19 or less.

EXAMPLES

<Components to be Blended>

In Examples and Comparative Examples, and Formulation Examples and Comparative Formulation Examples, the following components were used.

Synthesis of [Component (A)]

Internal olefins A to C which are raw materials of component (A) were synthesized as follows.

Synthesis of Internal Olefins a to C Having 16 Carbon Atoms (Production Examples a to C)

7000 g (28.9 mol) of 1-hexadecanol (product name: KALCOL 6098, manufactured by Kao Corporation) and 700 g of γ-alumina (Strem Chemicals, Inc.) as a solid acid catalyst were introduced into a flask equipped with a stirring device, and allowed to react at 280° C. with stirring for a different reaction time for each of Production Examples A to C while circulating nitrogen (7000 mL/min) inside the flask. The resulting crude internal olefin was transferred to a distillation flask and subjected to distillation at 136 to 160° C./4.0 mmHg to obtain each of internal olefins A to C having 16 carbon atoms at an olefin purity of 100%. The double bond distribution of each of the obtained internal olefins is shown in Table 1.

TABLE 1

| | | Internal olefin | | |
|---|---|---|---|---|
| | | A | B | C |
| Number of carbon atoms of hydrocarbon group | | 16 | 16 | 16 |
| Distribution of double bond in olefin as raw material (% by mass) | Position 1 | 1.8 | 0.5 | 0.4 |
| | Position 2 | 40.7 | 30.1 | 15.3 |
| | Position 3 | 29.3 | 25.5 | 13.8 |
| | Position 4 | 15.7 | 18.9 | 15.2 |
| | Position 5 | 7.3 | 11.0 | 18.4 |
| | Position 6 | 3.0 | 7.0 | 15.1 |
| | Position 7 | 1.1 | 3.5 | 10.9 |
| | Position 8 | 1.1 | 3.5 | 10.9 |
| | Position 9 | 0.0 | 0.0 | 0.0 |
| | Total | 100.0 | 100.0 | 100.0 |
| | Total of positions 5 to 9 | 12.5 | 25.0 | 55.3 |

The double bond distribution of each of the internal olefins was measured by gas chromatography (hereinafter abbreviated as GC). Specifically, the internal olefin was reacted with dimethyl disulfide to form its dithiolated derivative, and then each component was subjected to separation by GC. The double bond distribution of internal olefin was determined from each of the resulting peak areas. For the olefins having 16 carbon atoms, the internal olefin having a double bond at position 7 and the internal olefin having a double bond at position 8 cannot be distinguished from each other in structure but distinguished when they are sulfonated, therefore, the value obtained by dividing the amount of the internal olefin having a double bond at position 7 by 2 is conveniently shown in each of the columns for positions 7 and 8.

The devices and the analysis conditions used for the measurement are as follows: a GC system: "HP6890" (manufactured by Hewlett-Packard Company); a column: "Ultra-Alloy-1 HT Capillary Column" (30 m×250 μm×0.15 μm, manufactured by Frontier Laboratories, Ltd.); a detector (hydrogen flame ionization detector (FID)); injection temperature: 300° C.; detector temperature: 350° C.; and He flow rate: 4.6 mL/min.

Synthesis of Components (a-1) to (a-10)

Each of internal olefins A to C obtained in Examples A to C was subjected to sulfonation reaction by passing sulfur trioxide gas therethrough using a thin film-type sulfonation reactor equipped with an external jacket while passing cooling water at 20° C. through the external jacket. The molar ratio of $SO_3$/the internal olefin during the sulfonation reaction was set at 1.09. The resulting sulfonated product was added to an alkaline aqueous solution which had been prepared using sodium hydroxide in an amount of 1.5 molar times the theoretical acid value, and the mixture was neutralized at 30° C. for 1 hour while being stirred. The neutralized product was hydrolyzed by being heated in an autoclave at 160° C. for 1 hour to obtain a crude product of a sodium internal olefin sulfonate having 16 carbon atoms. 300 g of the crude product was transferred to a separating funnel, 300 mL of ethanol was added thereto and petroleum ether in an amount of 300 mL per time was then added thereto to extract and remove oil-soluble impurities. At this time, inorganic compounds (mainly including sodium sulfate decahydrate) which precipitated at the oil/water interface by the addition of ethanol was also separated and removed from the aqueous phase by oil-water separation operation. This extraction and removal operation was carried out three times. The aqueous phase was evaporated to dryness to obtain each of the components (a-1), (a-4) and (a-10), as sodium internal olefin sulfonates having 16 carbon atoms. The internal olefin sulfonate obtained by using internal olefin A as a raw material is referred to as component (a-1), the internal olefin sulfonate obtained by using internal olefin B as a raw material is referred to as component (a-4), and the internal olefin sulfonate obtained by using internal olefin C as a raw material is referred to as component (a-10).

The distribution of the positions of the carbon through which each of sulfonate groups of components (a-1), (a-4) and (a-10) obtained are attached is shown in Table 2.

The percentage of the content of the internal olefin sulfonate with the sulfonate group attached thereto of each component was measured by high performance liquid chromatography/mass spectrometer (HPLC-MS). Specifically, identification was carried out by separating the hydroxy form having the sulfonate group attached thereto by high performance liquid chromatography (HPLC) and subjecting it to mass spectrometer (MS). Each percentage was determined from the resulting HPLC-MS peak area. In the present specification, each percentage determined from the peak area was calculated as percentage by mass.

The devices and the analysis conditions used for the measurement are as follows: an HPLC device: "LC-20ASXR" (manufactured by Shimadzu Corporation); a column: "ODS Hypersil®" (4.6×250 mm, particle size: 3 μm, manufactured by Thermo Fisher Scientific K.K.); sample preparation (1000 times diluted with methanol); eluent A (10 mM ammonium acetate-added water); eluent B (a 10 mM ammonium acetate-added methacrylonitrile/water=95/5 (v/v) solution); gradient (0 minute (A/B=60/40)→15.1 to 20 minutes (30/70)→20.1 to 30 minutes (60/40); an MS device "LCMS-2020" (manufactured by Shimadzu Corporation); ESI detection (negative ion detection, m/z: 321.10 (component (A) having 16 carbon atoms); column temperature (40° C.); flow rate (0.5 mL/min); and injection volume (5 μL).

TABLE 2

| | | Component (A) | | |
|---|---|---|---|---|
| | | (a-1) | (a-4) | (a-10) |
| Number of carbon atoms of hydrocarbon group | | 16 | 16 | 16 |
| Distribution of sulfonate group (% by mass) | Position 1 | 0.7 | 1.5 | 0.6 |
| | Position 2 | 32.1 | 24.1 | 13.1 |
| | Position 3 | 24.2 | 19.9 | 11.5 |
| | Position 4 | 25.8 | 24.6 | 18 |
| | Positions 5 to 9 | 17.2 | 29.9 | 56.8 |
| | Total | 100 | 100 | 100 |

Then, component (a-1) and component (a-4) were mixed to prepare component (a-2) and component (a-3). Component (a-4) and component (a-10) were also mixed to prepare components (a-5) to component (a-9).

The double bond distribution of the internal olefins obtained which are a raw material for components (a-1) to (a-10) obtained is shown in Table 3.

The distribution of the positions of the carbon through which each of sulfonate groups of components (a-1) to (a-10) obtained are attached is shown in Table 4.

TABLE 3

| | | Component (A) | | | | | | | | | |
|---|---|---|---|---|---|---|---|---|---|---|---|
| | | (a-1) | (a-2) | (a-3) | (a-4) | (a-5) | (a-6) | (a-7) | (a-8) | (a-9) | (a-10) |
| Number of carbon atoms of olefin as raw material | | 16 | 16 | 16 | 16 | 16 | 16 | 16 | 16 | 16 | 16 |
| Distribution of double bond in olefin as raw material (% by mass) | Position 1 | 1.8 | 1.4 | 1.0 | 0.5 | 0.5 | 0.4 | 0.4 | 0.4 | 0.4 | 0.4 |
| | Position 2 | 40.7 | 38.1 | 34.2 | 30.1 | 27.6 | 25.2 | 22.7 | 20.2 | 17.8 | 15.3 |
| | Position 3 | 29.3 | 28.3 | 27.0 | 25.5 | 23.6 | 21.7 | 19.6 | 17.7 | 15.6 | 13.8 |
| | Position 4 | 15.7 | 16.5 | 17.6 | 18.9 | 18.3 | 17.7 | 17.1 | 16.5 | 15.8 | 15.2 |
| | Position 5 | 7.3 | 8.3 | 9.6 | 11.0 | 12.3 | 13.5 | 14.8 | 16.0 | 17.2 | 18.4 |
| | Position 6 | 3.0 | 4.0 | 5.4 | 7.0 | 8.3 | 9.7 | 11.0 | 12.4 | 13.8 | 15.1 |
| | Position 7 | 1.1 | 1.7 | 2.6 | 3.5 | 4.7 | 5.9 | 7.2 | 8.4 | 9.7 | 10.9 |
| | Position 8 | 1.1 | 1.7 | 2.6 | 3.5 | 4.7 | 5.9 | 7.2 | 8.4 | 9.7 | 10.9 |
| | Position 9 | 0 | 0 | 0 | 0.0 | 0 | 0 | 0 | 0 | 0 | 0 |
| | Total | 100.0 | 100.0 | 100.0 | 100.0 | 100.0 | 100.0 | 100.0 | 100.0 | 100.0 | 100.0 |
| | Total of positions 5 to 9 | 12.5 | 15.7 | 20.1 | 25.0 | 29.9 | 35 | 40.2 | 45.3 | 50.5 | 55.3 |

TABLE 4

| | | Component (A) | | | | | | | | | |
|---|---|---|---|---|---|---|---|---|---|---|---|
| | | (a-1) | (a-2) | (a-3) | (a-4) | (a-5) | (a-6) | (a-7) | (a-8) | (a-9) | (a-10) |
| Number of carbon atoms of hydrocarbon group | | 16 | 16 | 16 | 16 | 16 | 16 | 16 | 16 | 16 | 16 |
| Distribution of sulfonate group (% by mass) | Position 1 | 0.7 | 0.9 | 1.2 | 1.5 | 1.4 | 1.2 | 1.1 | 0.9 | 0.8 | 0.6 |
| | Position 2 | 32.1 | 30.2 | 27.2 | 24.1 | 22.3 | 20.4 | 18.6 | 16.8 | 14.9 | 13.1 |
| | Position 3 | 24.2 | 23.1 | 21.6 | 19.9 | 18.4 | 17.1 | 15.6 | 14.3 | 12.9 | 11.5 |
| | Position 4 | 25.8 | 25.5 | 25 | 24.6 | 23.5 | 22.4 | 21.3 | 20.2 | 19.1 | 18 |
| | Positions 5 to 9 | 17.2 | 20.3 | 25 | 29.9 | 34.4 | 38.9 | 43.4 | 47.8 | 52.3 | 56.8 |
| | Total | 100 | 100 | 100 | 100 | 100 | 100 | 100 | 100 | 100 | 100 |

[Component (B)]

(b-1): a polyoxyalkylene lauryl ether (a compound obtained by adding an average of 9 moles of an ethyleneoxy group per mole of lauryl alcohol, then adding an average of 2 moles of a propyleneoxy group per mole of lauryl alcohol and then adding an average of 9 moles of an ethyleneoxy group per mole of lauryl alcohol; HLB=14.5; a compound of the general formula (b1) wherein $R^1$ is a lauryl group, m is 0, $A^1O$ is an ethyleneoxy group and a propyleneoxy group, n is 20, and $R^2$ is a hydrogen atom)

(b-2): a polyoxyalkylene lauryl ether (the average number of moles of added oxyethylene group: 10 moles; HLB=14.0; a compound of the general formula (b1) wherein $R^1$ is lauryl group, m is 0, $A^1O$ is an ethyleneoxy group, n is 10, and $R^2$ is a hydrogen atom)

(b-3): a polyoxyethylene alkyl ether (the average number of moles of added oxyethylene group: 6 moles; HLB=12.1; a compound of the general formula (b1) wherein $R^1$ is a mixed alkyl group of a lauryl group and a myristyl group, the ratio of the mass of the lauryl group to the mass of the myristyl group (lauryl group/myristyl group)=9/1, m is 0, $A^1O$ is an ethyleneoxy group, n is 6, and $R^2$ is a hydrogen atom)

(b-4): a polyoxyethylene alkyl ether (the average number of moles of added oxyethylene group: 5 moles; HLB=10.7; a compound of the general formula (b1) wherein $R^1$ is a mixed alkyl group of a lauryl group and a myristyl group, the ratio of the mass of the lauryl group to the mass of the myristyl group (lauryl group/myristyl group)=9/1, m is 0, $A^1O$ is an ethyleneoxy group, n is 5, and $R^2$ is a hydrogen atom)

[Component (B')] (a Comparative Component of Component B)

(b-1): a polyoxyethylene lauryl ether (the average number of moles of added oxyethylene group: 3 moles; HLB=8.3; a compound of the general formula (b1) wherein $R^1$ is a lauryl group, m is 0, $A^1O$ is an ethyleneoxy group, n is 3, and $R^2$ is a hydrogen atom)

[Optional Component]

[Component (C)]

(c-1): a sodium alkylbenzene sulfonate (alkyl composition: C10/C11/C12/C13=11/29/34/26 (mass ratio); mass average number of carbon atoms=17.75)

[Water]

Ion-Exchanged Water

<Preparation of Detergent Compositions for Textile Products>

Detergent compositions for textile products shown in Tables 5 to 6 were prepared using the above-mentioned components to be blended, and were evaluated for the following items. The results are shown in Tables 5 to 6.

Specifically, the method for preparing the detergent compositions for fibers shown in Tables 5 to 6 was as follows. A Teflon® stirrer piece having a length of 5 cm was placed in a 200 mL glass beaker and its weight was measured. Next, 80 g of ion-exchanged water at 20° C., either component (A) or component (C) and either component (B) or component (B') were introduced thereinto, and the beaker was sealed at its top side with Saran Wrap®. The beaker containing the contents was placed in a water bath at 60° C. placed on a magnetic stirrer, and the contents were stirred at 100 r/min for 30 minutes at a water temperature range in the water bath of 60±2° C. Next, the water in the water bath was replaced with tap water at 5° C. and cooled until the temperature of the composition in the beaker was 20° C. Next, Saran Wrap® was removed, ion-exchanged water was added so that the weight of the contents was 100 g, and the contents were stirred again at 100 r/min for 30 seconds to obtain each of the detergent compositions for textile products shown in Tables 5 to 6.

In Formulation Examples 1 to 6 and Comparative Formulation Example 1 in Table 6, the detergent compositions for textile products were compositions prepared by setting the total of the content of component (A) and the content of component (B) in detergent composition for textile products as 10% by mass, and changing the mass ratios between component (A) and component (B). In each Formulation Example, the composition was a composition prepared by using one of (a-1) to (a-10) as component (A). As component (B), (b-1) was used in Formulation Examples 1 to 3, (b-2) was used in Formulation Example 4, (b-3) was used in Formulation Example 5, and (b-4) was used in Formulation Example 6, respectively.

<Evaluation Method>

[Preparation of Textile Products for Evaluation]

(1) Preparation of Textile Products for Evaluation of Adsorption Percentage of Surfactants 1.7 kg of knitted cotton (un-mercerized knitted cotton (not mercerized one), cotton 100%, manufactured by Shikisensha Co., Ltd.) was washed cumulatively twice with a standard course of a fully automatic washing machine (NA-F702 P manufactured by Matsushita Electric Industrial Co., Ltd.) (4.7 g of Emulgen 108 (manufactured by Kao Corporation) at washing; water amount: 47 L; washing for 9 minutes, rinsing twice and spin-drying for 3 minutes) followed by cumulatively washing three times with water only (water amount: 47 L; washing for 9 minutes, rinsing twice and spin-drying for 3 minutes), and dried under an environment of 23° C. and 45% RH for 24 hours. It was then cut into 6 cm×6 cm in size.

(2) Preparation of Textile Products for Evaluation of Washing Percentage

Preparation of the Model Artificially Sebum-Stained Cloth

A model artificially sebum-stained cloth was prepared by applying a model artificially sebum-staining liquid of the following composition to a cloth (Cotton 2003 (manufactured by Tanigashira Shoten)). The application of the model artificially sebum-staining liquid to the cloth was carried out by printing the artificially staining liquid on the cloth using a gravure roll coater. The process for preparing the model artificially sebum-stained cloth by applying the model artificially sebum-staining liquid to the cloth was carried out with a cell capacity of the gravure roll of 58 $cm^3/m^2$, a coating speed of 1.0 m/min, a drying temperature of 100° C. and a drying time of 1 minute. The cloth was then cut into 6 cm×6 cm in size.

*The composition of the model artificially sebum-staining liquid: lauric acid: 0.4% by mass, myristic acid: 3.1% by mass, pentadecanoic acid: 2.3% by mass, palmitic acid: 6.2% by mass, heptadecanoic acid: 0.4% by mass, stearic acid: 1.6% by mass, oleic acid: 7.8% by mass, triolein: 13.0% by mass, n-hexadecyl palmitate: 2.2% by mass, squalene: 6.5% by mass, egg white lecithin liquid crystal product: 1.9% by mass, Kanuma red clay: 8.1% by mass, carbon black: 0.01% by mass and water: balance (total 100% by mass).

[Washing Test]

(1) Washing Test 1

Washing procedure was carried out by using Terg-0-Tometer (manufactured by Ueshima Seisakusho Co., Ltd.). The water to be used for washing was obtained by adding calcium chloride and magnesium chloride to ion-exchanged water at a mass ratio of 8:2 and adjusting the hardness to 4° dH. The detergent liquid was obtained by mixing each detergent composition for textile products shown in Tables 5 or 6 with the water for washing so that the total amount of component (A), component (B), component (C) and component (B') in the detergent composition for textile products is at a concentration of 167 mg/kg in the detergent liquid. 0.6 L of the detergent liquid and five cut pieces of each of the above-mentioned textile products for evaluation of adsorption percentage of surfactants were introduced into a 1 liter-stainless steel beaker. The bath ratio was adjusted to 15 with respect to each of the above-mentioned textile products for evaluation of adsorption percentage. The temperature of the detergent liquid was 20° C. Each of the textile products for evaluation was washed at 85 rpm with Terg-O-Tometer for 10 minutes. After washing, it was spin-dried and dried in an environment of 23° C. and 45% RH for 24 hours.

(2) Washing Test 2

Washing procedure was carried out by using Terg-O-Tometer (manufactured by Ueshima Seisakusho Co., Ltd.). The water to be used for washing was obtained by adding calcium chloride and magnesium chloride to ion-exchanged water at a mass ratio of 8:2 and adjusting the hardness to 4° dH. The detergent liquid was obtained by mixing each detergent composition for textile products shown in Tables 5 or 6 with the water for washing so that the total amount of component (A), component (B), component (C) and component (B') in the detergent composition for textile products is at a concentration of 167 mg/kg in the detergent liquid. 0.6 L of the detergent liquid and five cut pieces of each of the above-mentioned textile products for evaluation of washing percentage were introduced into a 1 liter-stainless steel beaker. The bath ratio was adjusted to 15 with respect to each of the above-mentioned textile products for evaluation of washing percentage, and the temperature of the detergent liquid was 20° C. Each of the textile products for evaluation was washed at 85 rpm with Terg-O-Tometer for 10 minutes. After washing, it was spin-dried and was dried with an iron press machine.

[Quantification of Amount of Surfactants Adsorbed to Textile Products]

Two cut pieces were taken out of the cut pieces of each of the textile products for evaluation of adsorption percentage of surfactants after the washing test 1, and the cut pieces were weighed while being sealed in a No. 7 screw tube. 40 mL of a methanol/chloroform solution (methanol:chloroform=1:1 (by volume)) was added thereto, and subjected to ultrasonication for 50 minutes with an ultrasonic washing machine. The extract was diluted 20 times to prepare a solution to be measured. Next, each of component (A), component (B) and component (C) was diluted with a methanol/chloroform solution (methanol:chloroform=1:1 (by volume)) to prepare 0.1 μg/mL, 0.5 μg/mL, 1 μg/mL and 5 μg/mL solutions for preparing a calibration curve. The amount of the surfactant in the solution to be measured was quantified by a liquid chromatograph/mass spectrometer (hereinafter abbreviated as LCMS device), and the amount of the active agent adsorbed to textile product from the solution for preparing calibration curve was determined.

LCMS device: LCMS-2020, manufactured by Shimadzu Corporation

Eluent A: a 10 mmol/L aqueous solution of ammonium acetate in distilled water

Eluent B: a 10 mmol/L methanolic solution of ammonium acetate

Gradient condition: eluent A/B=1:1 (0 minutes)→eluent B (2 to 5 minutes)→eluent A/eluent B=1/1 (5.1 minutes to 8 minutes), flow rate: 0.6 mL/min, sample injection volume: 5 μl, column temperature: 40° C.

The adsorption percentage of the surfactant to textile products was determined by the following formula. The results are shown in Table 5.

Adsorption percentage of total surfactants=100×{(total weight of surfactants adsorbed to two cut pieces of textile product used for measurement of adsorption amount)×(total weight of textile product used in washing test 1)/(weight of two pieces of textile product used in measurement of adsorption amount)}/(total weight of surfactants used for preparation of detergent liquid)

[Evaluation Method of Washing Percentage]

The washing percentage of the textile product to be evaluated obtained in the washing test 2 was measured by the following method, and the average value of 5 cut pieces was determined. The results are shown in table 6.

The reflectance at 550 nm of each of the original cloth before staining and the clothes before and after washing was measured with a differential colorimeter (Z-300A, manufactured by Nippon Denshoku Industries Co., Ltd.), and the washing percentage (%) was determined by the following formula (the values in Table 6 are average values of the washing percentages for 5 cut pieces).

Washing percentage (%)=100×[(reflectance after washing−reflectance before washing)/(reflectance of original cloth−reflectance before washing)]

TABLE 5

| | | | | Example | | | Comparative Example | | | | |
|---|---|---|---|---|---|---|---|---|---|---|---|
| | | | | 1 | 2 | 3 | 1 | 2 | 3 | 4 | 5 |
| Detergent composition for textile products | Content (% by mass) | Component (A) | (a-1) | 5 | | | 10 | | | | |
| | | | (a-4) | | 5 | | | 10 | | | 5 |
| | | | (a-10) | | | 5 | | | 10 | | |
| | | Component (B) | (b-1) | 5 | 5 | 5 | | | | 5 | |
| | | Component (B') | (b'-1) | | | | | | | | 5 |
| | | Component (C) | (c-1) | | | | | | | 5 | |
| | | Ion-exchanged water | | Balance | Balance | Balance | Balance | Balance | Balance | Balance | Balance |
| | | Total | | 100 | 100 | 100 | 100 | 100 | 100 | 100 | 100 |
| | | (B)/(A) (mass ratio) | | 1 | 1 | 1 | — | — | — | — | — |
| Evaluation results | | Adsorption percentgage of surfactant (%) | | 28.8 | 25.6 | 24.3 | 39.7 | 36.3 | 32.8 | 40.3 | 48.7 |

(Discussion)

Table 5 shows that when comparing Comparative Example 4 with Examples, the amount of the surfactant adsorbed to the textile product after washing was reduced more by using component (A) of the present invention as anionic surfactant than by using the alkylbenzene sulfonate which is a detergent component generally used. It is also shown that the amount of the surfactant adsorbed to the textile product after washing was reduced by using component (A) and component (B) in combination. It is further shown that even if component (A) of the present invention was used, the adsorption percentage was not reduced when using surfactants other than component (B) of the present invention.

TABLE 6

| | Component (B) used | (B)/(A) (mass ratio) | Washing percentage (%) | | | | | | | | | |
|---|---|---|---|---|---|---|---|---|---|---|---|---|
| Formulation Example 1 | (b-1) | 0.11 | 31 | 30 | 31 | 32 | 31 | 32 | 30 | 30 | 28 | 25 |
| Formulation Example 2 | (b-1) | 0.25 | 31 | 33 | 32 | 33 | 31 | 32 | 32 | 31 | 31 | 32 |
| Formulation Example 3 | (b-1) | 0.43 | 33 | 34 | 33 | 35 | 33 | 34 | 32 | 34 | 34 | 35 |
| Formulation Example 4 | (b-2) | 0.25 | 32 | — | — | 33 | — | — | 32 | 32 | 31 | 32 |
| Formulation Example 5 | (b-3) | 0.25 | 31 | — | — | 32 | — | — | 31 | 31 | 31 | 31 |
| Formulation Example 6 | (b-4) | 0.25 | 31 | — | — | 32 | — | — | 32 | 30 | 29 | 26 |
| Comparative Formulation Example 1 | None | 0 | 31 | 32 | 31 | 31 | 29 | 31 | 28 | 27 | 25 | 24 |
| Component used as component (A) | | | (a-1) | (a-2) | (a-3) | (a-4) | (a-5) | (a-6) | (a-7) | (a-8) | (a-9) | (a-10) |
| Content of olefin having double bond at positions 5 to 9, in olefin as raw material of component (A) (% by mass) | | | 12.5 | 15.7 | 20.1 | 25.0 | 29.9 | 35 | 40.2 | 45.3 | 50.5 | 55.3 |
| Content of internal olefin sulfonate having sulfonate group at positions 5 to 9, in component (A) (% by mass) | | | 17.2 | 20.3 | 25 | 29.9 | 34.4 | 38.9 | 43.4 | 47.8 | 52.3 | 56.8 |

(Discussion)

Table 6 shows that if component (A) was used alone as in Comparative Formulation Example 1, the detergent property changed when the content of the olefin having a double bond at position 5 or higher in the olefin as a raw material for component (A) changed. However, from Formulation Examples 1 to 6 in which component (A) and component (B) were used in combination, it is shown that the washing percentage did not change over a wider range of the content of the olefin having a double bond at position 5 or higher in the olefin as a raw material for component (A). Further, it is shown that as the content ratio of component (B) increased, the washing percentage did not change over a still wider range of the content of the olefin having a double bond at position 5 or higher in the olefin as a raw material for component (A).

The invention claimed is:

1. A detergent composition for textile products comprising the following component (A) and component (B):

component (A): an internal olefin sulfonate having 15 or more and 24 or less carbon atoms and including an internal olefin sulfonate having 15 or more and 24 or less carbon atoms with the sulfonate group at position 5 or higher, and component (B): a nonionic surfactant having an HLB of more than 10.5 and 19 or less, wherein the content of the internal olefin sulfonate having 15 or more and 24 or less carbon atoms with the sulfonate group at position 5 or higher in component (A) is 29.9% by mass or more, and wherein a mass ratio (B)/(A) of the component (B) to the component (A) is 0.05 or more and 9 or less.

2. The detergent composition for textile products according to claim 1, wherein the component (B) is a nonionic surfactant containing a polyoxyethylene group and having an HLB of more than 10.5 and 19 or less.

3. The detergent composition for textile products according to claim 1, wherein the component (B) is a nonionic surfactant having an HLB of more than 10.5 and 19 or less and represented by the following general formula (b1):

$$R^1(CO)_mO\text{-}(A^1O)_n\text{—}R^2 \quad \text{(b1)}$$

wherein $R^1$ is an aliphatic hydrocarbon group having 9 or more and 18 or less carbon atoms, $R^2$ is a hydrogen atom or a methyl group, CO is a carbonyl group, m is 0 or 1, $A^1O$ group is one or more groups selected from an ethyleneoxy group and a propyleneoxy group, and n is an average number of added moles and is 6 or more and 50 or less.

4. The detergent composition for textile products according to claim 3, wherein in the general formula (b1), the $A^1O$ group is a group containing an ethyleneoxy group.

5. The detergent composition for textile products according to claim 1, wherein the component (A) is an internal olefin sulfonate having 15 or more and 24 or less carbon atoms and including 29.9% by mass or more and 60% by mass or less of an internal olefin sulfonate having 15 or more and 24 or less carbon atoms with the sulfonate group at position 5 or higher.

6. The detergent composition for textile products according to claim 1, wherein the component (A) is one or more selected from the following component (a1) and component (a2), wherein a mass ratio (a2)/(a1) of the component (a2) to the component (a1) is 0 or more and 1 or less:

component (a1): an internal olefin sulfonate having 15 or more and 16 or less carbon atoms and including an internal olefin sulfonate having 15 or more and 16 or less carbon atoms with the sulfonate group at position 5 or higher, and component (a2): an internal olefin sulfonate having 17 or more and 24 or less carbon atoms and including an internal olefin sulfonate having 17 or more and 24 or less carbon atoms with the sulfonate group at position 5 or higher.

7. The detergent composition for textile products according to claim 1, wherein a total of the content of the component (A) and the content of the component (B) in all surfactants in the detergent composition for textile products is 60% by mass or more and 100% by mass or less.

8. The detergent composition for textile products according to claim 1, further comprising water.

9. The detergent composition for textile products according to claim 1, wherein a total of the content of the component (A) and the content of the component (B) in the detergent composition for textile products is 4% by mass or more and 60% by mass or less.

10. A method for washing textile products with a detergent liquid comprising the following component (A) and component (B), and water, wherein a hardness of the detergent liquid is more than 0° dH:

component (A): an internal olefin sulfonate having 15 or more and 24 or less carbon atoms and including an internal olefin sulfonate having 15 or more and 24 or less carbon atoms with the sulfonate group at position 5 or higher, component (B): a nonionic surfactant having an HLB of more than 10.5 and 19 or less, wherein the content of the internal olefin sulfonate having 15 or more and 24 or less carbon atoms with the sulfonate group at position 5 or higher in component (A) is 29.9% by mass or more, and wherein in the detergent liquid, a mass ratio (B)/(A) of the component (B) to the component (A) is 0.05 or more and 9 or less.

11. The method for washing textile products according to claim 10, wherein the component (B) is a nonionic surfactant containing a polyoxyethylene group and having an HLB of more than 10.5 and 19 or less.

12. The method for washing textile products according to claim 10, wherein the component (B) is a nonionic surfactant having an HLB of more than 10.5 and 19 or less and represented by the following general formula (b1):

$$R^1(CO)_m O\text{-}(A^1O)_n\text{—}R^2 \quad \text{(b1)}$$

wherein $R^1$ is an aliphatic hydrocarbon group having 9 or more and 18 or less carbon atoms, $R^2$ is a hydrogen atom or a methyl group, CO is a carbonyl group, m is 0 or 1, $A^1O$ group is one or more groups selected from an ethyleneoxy group and a propyleneoxy group, and n is an average number of added moles and is 6 or more and 50 or less.

13. The method for washing textile products according to claim 12, wherein in the general formula (b1), the $A^1O$ group is a group containing an ethyleneoxy group.

14. The method for washing textile products according to claim 10, wherein the component (A) is an internal olefin sulfonate having 15 or more and 24 or less carbon atoms and including 29.9 by mass or more and 60% by mass or less of an internal olefin sulfonate having 15 or more and 24 or less carbon atoms with the sulfonate group at position 5 or higher.

15. The method for washing textile products according to claim 10, wherein the content of the internal olefin sulfonate having 15 or more and 24 or less carbon atoms with the sulfonate group at position 2 or higher in the component (A) is 10% by mass or more and 60% by mass or less.

16. The method for washing textile products according to claim 10, wherein the component (A) is one or more selected from the following component (a1) and component (a2), and a mass ratio (a2)/(a1) of the component (a2) to the component (a1) in the detergent liquid is 0 or more and 1 or less:

component (a1): an internal olefin sulfonate having 15 or more and 16 or less carbon atoms and including an internal olefin sulfonate having 15 or more and 16 or less carbon atoms with the sulfonate group at position 5 or higher, and component (a2): an internal olefin sulfonate having 17 or more and 24 or less carbon atoms and including an internal olefin sulfonate having 17 or more and 24 or less carbon atoms with the sulfonate group at position 5 or higher.

17. The method for washing textile products according to claim 10, wherein a total of the content of the component (A) and the content of the component (B) in all surfactants in the detergent liquid is 60% by mass or more and 100% by mass or less.

18. The method for washing textile products according to claim 10, wherein the hardness of the detergent liquid is, by German hardness, 0.5° dH or more and 20° dH or less.

19. The method for washing textile products according to claim 10, wherein the content of the component (A) in the detergent liquid is 0.005% by mass or more and 1.0% by mass or less, and the content of the component (B) in the detergent liquid is 0.001% by mass or more and 5.0% by mass or less.

20. A method for producing a detergent composition for textile products, comprising mixing the following component (A) and component (B):

component (A): an internal olefin sulfonate having 15 or more and 24 or less carbon atoms and including an internal olefin sulfonate having 15 or more and 24 or less carbon atoms with the sulfonate group at position 5 or higher, and component (B): a nonionic surfactant having an HLB of more than 10.5 and 19 or less, wherein the content of the internal olefin sulfonate having 15 or more and 24 or less carbon atoms with the sulfonate group at position 5 or higher in component (A) is 29.9% by mass or more, and wherein a mass ratio (B)/(A) of the component (B) to the component (A) is 0.05 or more and 9 or less.

* * * * *